US005988424A

United States Patent [19]

Kovens

[11] Patent Number: 5,988,424

[45] Date of Patent: Nov. 23, 1999

[54] HINGED LID CLOSURE DISPENSING CAPSULE

[75] Inventor: Edward B. Kovens, Reisterstown, Md.

[73] Assignee: Parkway Machine Corporation, Timonium, Md.

[21] Appl. No.: 09/057,985

[22] Filed: Apr. 10, 1998

[51] Int. Cl.[6] ..... B65D 6/12; B65D 6/16; B65D 51/18

[52] U.S. Cl. ..... 220/259; 220/835; 220/837; 220/847; 206/540

[58] Field of Search ..... 220/837, 847, 220/833, 834, 835, 259, 254, 796, 805, 780, 793, DIG. 13, 4.21, 4.24, 4.25; 206/822, 579, 540; D7/608; D9/519

[56] References Cited

U.S. PATENT DOCUMENTS

| | | | |
|---|---|---|---|
| D. 254,716 | 4/1980 | Mascia et al. | D9/519 |
| 3,292,840 | 12/1966 | Schmidt | 220/4.24 |
| 3,381,844 | 5/1968 | Sieve | 220/4.21 |
| 3,872,996 | 3/1975 | Dogliotti | 220/254 |
| 4,124,135 | 11/1978 | Weder et al. | 220/4.25 |
| 4,244,470 | 1/1981 | Burnham | 220/4.24 |
| 4,759,478 | 7/1988 | Richardson et al. | 220/254 |
| 4,765,501 | 8/1988 | Kao | 220/4.21 |
| 5,064,073 | 11/1991 | Folland | 206/822 X |
| 5,273,177 | 12/1993 | Campbell | 220/254 |
| 5,636,732 | 6/1997 | Gilels et al. | 220/254 |

*Primary Examiner*—Stephen K. Cronin
*Assistant Examiner*—Nathan Newhouse
*Attorney, Agent, or Firm*—Cahn & Samuels, LLP

[57] ABSTRACT

A hinge flap capsule for containing a pourable material or articles being capable of non-destructive opening and re-sealing where the capsule is formed of a shell container and a cap interference fit thereto and the hinge flap is integrally formed with the cap to permit repeated opening and closure of the capsule for access to the contents thereof, where the capsule is particularly suited for use in vending pourable (fluid) materials from bulk vending machines.

3 Claims, 1 Drawing Sheet

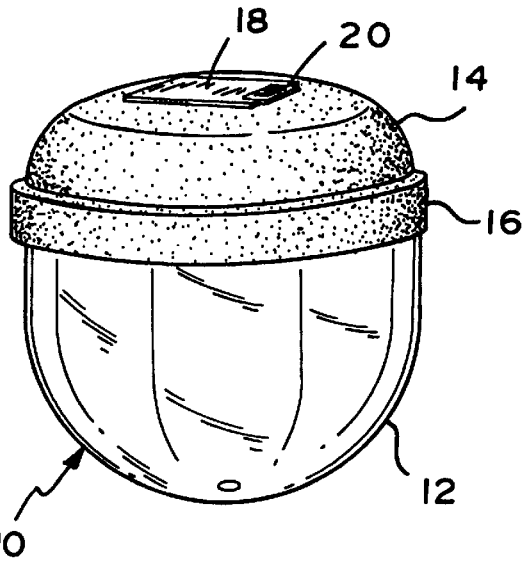
FIG. 1
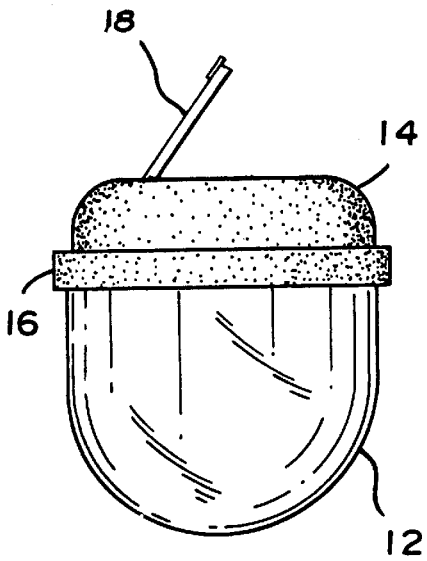
FIG. 3
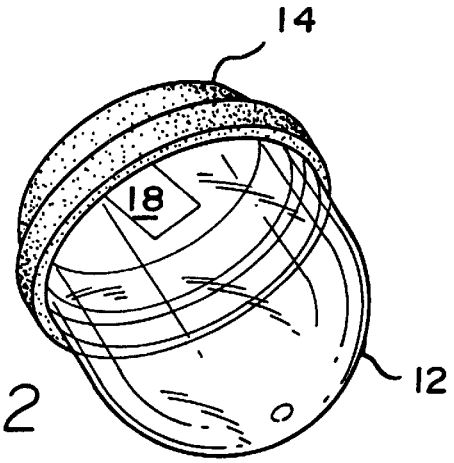
FIG. 2
FIG. 4
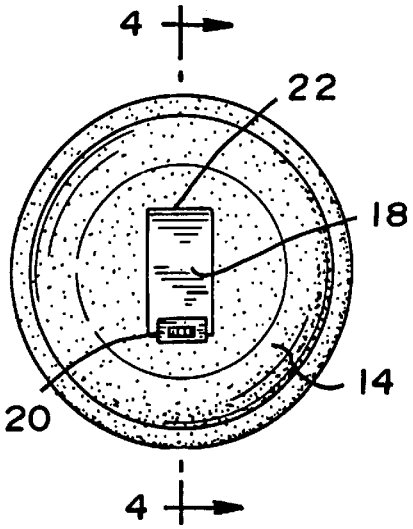
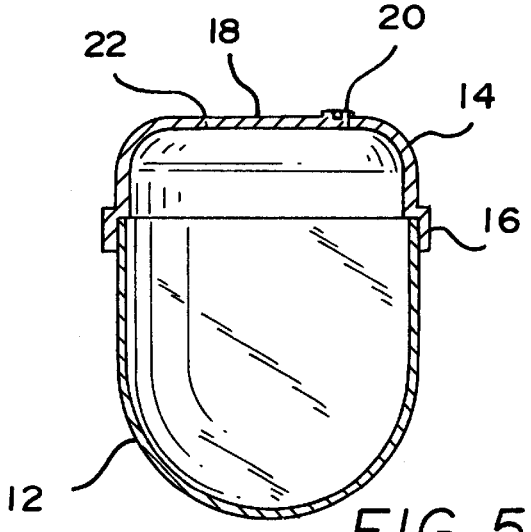
FIG. 5

HINGED LID CLOSURE DISPENSING CAPSULE

TECHNICAL FIELD

The present invention is directed to improvements in dispensing capsules for use in vending machines. The inventive capsule herein defines a convenient, re-enterable, structural combination useful in the vending arts for dispensing small objects and/or granulated/flowable materials, and particularly suited for use in bulk vending machines.

BACKGROUND OF THE INVENTION

The bulk vending arts commonly employ injection molded plastic capsules for storing and dispensing discrete items such as small toys, nuts, candy, and the like. Without encapsulation, small items often possessing irregularly shaped peripheral surfaces, cannot be dispensed or otherwise will jam in the dispensing mechanism of a typical bulk vending machine. Not only does such jamming prevent proper operation of the machine and corresponding loss of revenue, but also it creates the need for additional maintenance caused by undesirable residue and debris. For this reason the industry has adopted use of bifurcated plastic capsules to encapsulate smaller/pourable products to allow vending thereof from conventional bulk vending machines. Providing a substantially regular outer surface, small items sealed in a capsule effectively eliminates jamming. Furthermore, by encasing the items, the amount of waste and residue in the storage hopper and dispensing mechanism is reduced, thus, reducing maintenance requirements.

A common form of plastic encapsulation packaging is the ovoid or "egg" shaped capsule. Such capsules typically provide an oblongated shell achieved by an interference fit of either two half eggs or a half egg combined with a cap. In the bulk vending field such capped capsules are composed of two molded plastic sections, one being hemispherical and being composed of clear polystyrene and the other comprising a snap-on, rounded, polyethylene or polypropylene cap. In either form, the resulting capsules are capable of receiving and retaining a specific quantity of candy, goop, nuts, toys, miscellaneous small articles, etc. Such eggs, while perfectly suited for various single-use retail and vending applications, do not contemplate certain problems associated with specific bulk vending applications involving pluralities of very small, particulate, or fluid items. In the case of finely particulate confectioneries (small bead candy, flavored sugars, drops, etc.) the efficacy of the capsule is limited by the number of times it can be reentered by the purchaser to access the contents. In the case of colored or flavored sugars, for example, the capsule can be rendered effectively useless by when one of the capsule components breaks, thus preventing effective resealing. Furthermore, a bifurcated capsule may not be suitably adapted for sequential opening and closing.

For example, the structural integrity of the closure may be compromised once the interference or friction fit components are separated. In such a case, the capsule cannot be resealed properly leading to separation of the capsule halves and resulting spillage of the previously encapsulated items (nuts, small candies, etc.) The breakage problem is not necessarily eliminated by merely changing the composition, increasing the thickness (and expense), etc. of the interference fit portions. Where the degree of interference or friction fit is increased to provide for adequate capsule reassembly while preserving structural integrity, non-destructive separation of the capsule components for access to the capsule contents may become increasingly difficult. Given that children are the most common consumers of such containers in the bulk vending field, requiring increased coordinated force to overcome enhanced frictional engagement may pose a problem and be beyond the capabilities of the purchaser, particularly a young or disabled purchaser.

One example of a capsule that appears to address the vending pourable materials from bulk vending apparatus is described in U.S. Pat. No. 5,064,073. That patent provides an outer shell for dispensing pourable or very small items. It represents a one-piece construction with a small capped opening. However, as described, the opening is illustrated with a tape seal, which is not readily adapted for reentry.

Another, somewhat more familiar, container for controlled dispensing of small items and possessing a re-enterable, plastic molded, hinge-flap containing opening, is the "TIC-TAC" box. However, the box structure of such a box-like container is not generally suitable for bulk vending applications.

The foregoing underscores the problems associated with conventional egg/capsule structures in connection with controlled, discretionary dispensing of small/particulate items contained by the capsule. Furthermore, the foregoing highlights a need for a readily re-enterable capsule capable of being dispensed from a bulk vending machine and dispensing small/particulate items in a controlled manner.

SUMMARY OF THE INVENTION

It is therefore an object of the present invention to provide a vendible capsule structure that overcomes shortcomings and problems of the prior art.

It is another object of the invention to provide an improved plastic re-enterable capsule capable of use in the bulk vending field.

It is another object of the invention to provide an improved bifurcated plastic capsule capable of re-entry and for providing a dispenser for small particulate items for uniform vending in the bulk-vending field.

Still another object of the present invention to provide a capsule of adequate structural integrity to provide for multiple re-enterable, hinged opening providing select access to the capsule content.

A further object of this invention is to provide a capsule structure providing, at once, pourable dispensing, re-enterability, uniformity, adequate strength, structural integrity, and reusability.

A further object of this invention is to provide a re-enterable hinged opening in a capsule that may be conveniently and efficiently accessed.

It is another object of this invention to provide for customizable packaging by allowing selection of color and clarity of the shell and which can allow for confirmation of product identity and character.

These and other objects are satisfied by a plastic container package, featuring:

- a generally hollow, substantially hemi-spherical, molded polymeric capsule member formed by a wall and having an annular opening with a generally circular periphery of a first diameter,
- a molded polymeric cap having an annular lip dimensioned to correspond to the first diameter and to cooperate with the capsule member to establish a secure interference fit between the cap and the member, said cap featuring a planar area having formed therein an opening and a flap corresponding to the size of the opening, said flap being attached to the cap with a hinge for successive access to the content of the capsule and non-destructive reopening and closure of the flap to seal the capsule container.

Further objects of the present invention are satisfied by a resealable hinge flap opening for a plastic bulk vending capsule, comprising:

a generally hollow, substantially hemi-spherical shell having a generally circular rim of a select diameter;

a hat-shaped hinge flap cap molded from a polymer, said cap having a generally circular lip corresponding to the diameter of the circular rim and being dimensioned to cooperate therewith to provide an interference fit by frictional engagement to securely join the shell and the cap together thereby establishing a substantially hollow capsule container compatible for bulk vending dispensing;

said cap including a round planar surface having a rectangular opening formed therethrough and a hinged flap closure dimensionally corresponding to the opening to fit there in and seal the opening, said hinge flap being connected to the cap by a hinge element having a thickness less than the flap so as to bend at the hinge and a finger latch to facilitate gripping and resealing of the hinge flap within the opening.

The invention herein is an expedient to the bulk-vending industry and its customers. It essentially provides a customer with controlled consumption of flowable encapsulated items without the need for repackaging or affixing an independent plug to obstruct the opening. The invention provides a convenient, unitary, re-enterable container particularly suited for bulk vending of particulated or fluid materials.

The word "hemi-spherical" is intended to embrace geometric configurations that are both truly hemispherical as well as those approaching hemispherical.

Given the following enabling description of the drawings, the inventive generally spherical capsule package particularly suited for use in connection with bulk vending machines should become evident to a person of ordinary skill in the art.

BRIEF DESCRIPTION OF THE DRAWINGS

FIG. 1 is a perspective view of a spherical capsule package according to the invention.

FIG. 2 is bottom perspective view of the embodiment illustrated in FIG. 1.

FIG. 3 is a side view showing the hinge flap in the open position of the embodiment illustrated in FIG. 1.

FIG. 4 is a top view of the embodiment illustrated in FIG. 1.

FIG. 5 is a cross-sectional view of the embodiment illustrated in FIG. 1.

DETAILED DESCRIPTION OF THE PREFERRED EMBODIMENT

FIG. 1 illustrates a novel, hemi-spherical, bifurcated capsule 10 according to the present invention. The capsule 10 is established by the friction or interference fit of the, clear, polystyrene, lower hemispheric container 12 and the flatish low-density polyethylene/polypropylene cap 14. Both of the capsule components 12 and 14 are preferably formed by injection molding. The container 12 is illustrated as a clear color, and transparent 2–10 mil polystyrene. Typically the container wall thickness will be about 3 mil thick except along the equatorial band (underlying friction annular lip 16 of the cap) where the thickness may increase to 6 mils.

The cap 14, as viewed from its side (See FIG. 3) provides a hat-like (stylized bowler) profile. The cap 14 features a flat portion into which hinge flap 18 is formed. The hinge flap 18 is nested in an opening formed in cap 14 and is sized to correspond to the dimensions of the opening. The flap 18 is connected to the cap by the plastic hinge 22 which is separated therefrom on the three remaining sides from the cap. The hinge preferably is formed during molding by providing a ridge in the mold that translates to a score line of reduced polymer thickness. Preferably the polymer has sufficient elasticity to permit it be bent repeatedly without breaking. Molded, low-density polyethylene and polypropylene possess the engineering characteristics desired for this purpose. At the end of the flap 18, opposite to the hinge 22 a latching protrusion 20 is formed to facilitate closure and gripping. The latching protrusion 20 includes a protrusion/augmented thickness at the opening end to both insure latching to confronting cap surface and to facilitate finger gripping to disengage the flap 18 and pivot it about the hinge 22 to access the opening in the cap and, therefore, the content of the capsule 10.

Once the content is introduced to the capsule at the factory, shop, etc., the cap 14 is friction/interference fit over the circular opening of the container 12. The annular lip/band 16 which has an interior dimension graduating slightly to a diameter less than the outer diameter of the container 12 opening. Thus, a secure closure is established by compression fitting the cooperating surfaces to achieve friction mating of the cap 14 over the opening of the capsule 12. This assembly of the friction-fit components is enhanced by a preferred snap-fit feature. The snap fit feature is achieved using inclined (beveled) faces formed on the cooperatively mating surfaces. The annular lip 16 includes an interior face at angled approximate 5° which corresponds to a 5° incline molded into the corresponding rim annulus on the capsule portion 12. The slight degree of beveling serve to cause a "snap" upon engagement and also provide significantly enhanced frictional engagement to form a secure closure.

The improved structure of this invention is focused on the incorporation of a hinge flap 18 integrally formed in hat-shaped cap 14, preferably in the flat portion thereof. As illustrated, the hinge flap 18 is formed of the same polymer during the same injection-molding step as the formation of the cap 14. The outline of both the connecting hinge and the flap is defined in the mold cavity. Thus no additional manufacturing steps (cutting and the like) are required to achieve the hinge flap structure and functionality. Consequently the modification of existing molds or construction of new molds comprise the most significant expense in producing the invention.

The invention also is readily adaptable to variations. For example, the hinge flap may be produced separately and incorporated into the appropriate opening formed in the flat surface of cap 14 and may be secured using elastomeric adhesive and the like.

It should be apparent to the skilled artisan, that any appropriate shell forming composition may be used to establish the present invention so long as the interconnection between the hinge flap 18 and the cap 14 retains sufficient structural integrity and possesses adequate strength to provides multiple opening and closing of the hinge flap. Although the foregoing refers to polymers, moldable, biodegradable cellulose or cellulose byproducts can be used to form the cap and container which might limit visual access to the contents. However, this disadvantage can be offset by enhanced environmental considerations.

The design variations are essentially unlimited so long as the design provides a hinged flap opening to the retrieve pourable capsule contents in a selective manner.

Given the foregoing, variations and modifications to the invention should now be apparent to a person having ordinary skill in the art. These variations and modifications are intended to fall within the scope and spirit of the invention as defined by the following claims.

I claim:

1. A resealable hinge flap opening for a plastic bulk vending capsule, comprising:

a generally hollow, substantially hemi-spherical shell having a generally circular rim of a select diameter;

a hat-shaped hinge flap cap molded from a polymer, said cap having a generally circular lip corresponding to the diameter of the circular rim and being dimensioned to cooperate therewith to provide an interference fit by frictional engagement to securely join the shell and the cap together thereby establishing a substantially hollow capsule container compatible for bulk vending dispensing;

said cap including a round planar surface having a generally centrally positioned rectangular opening formed therethrough and a planar hinged flap closure dimensionally corresponding to the opening to fit there in and seal the opening, said planar hinge flap being formed in one piece with the cap by a hinge element having a thickness less than the flap so as to bend at the hinge and a finger latch protruding in a substantially planar direction from the planar hinge flap to facilitate gripping and resealing of the planar hinge flap within the opening.

2. The plastic bulk vending capsule of claim 1 wherein the cap is formed of a polymer.

3. The plastic bulk vending capsule of claim 2 wherein the latch is formed at an opposite side of the planar hinge flap from the hinge.

* * * * *